US009702624B2

(12) United States Patent
Toya et al.

(10) Patent No.: US 9,702,624 B2
(45) Date of Patent: Jul. 11, 2017

(54) DRYING APPARATUS, PRINTING APPARATUS, AND DRYING METHOD WITH TEMPERATURE ADJUSTMENT OF MEDIUM

(71) Applicant: SEIKO EPSON CORPORATION, Tokyo (JP)

(72) Inventors: Akihiro Toya, Nagano (JP); Jun Yamada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/962,073

(22) Filed: Dec. 8, 2015

(65) Prior Publication Data

US 2016/0167403 A1 Jun. 16, 2016

(30) Foreign Application Priority Data

Dec. 15, 2014 (JP) ..... 2014-252637

(51) Int. Cl.
*F26B 13/18* (2006.01)
*F26B 17/28* (2006.01)
*B41J 11/00* (2006.01)

(52) U.S. Cl.
CPC ..... *F26B 13/183* (2013.01); *B41J 11/002* (2013.01); *F26B 13/18* (2013.01); *F26B 17/284* (2013.01)

(58) Field of Classification Search
CPC ..... F26B 13/183; F26B 13/18; F26B 17/284; B41J 11/002
See application file for complete search history.

(56) References Cited

U.S. PATENT DOCUMENTS

2011/0249067 A1 10/2011 Izawa et al.
2012/0013671 A1 1/2012 Houjou
2014/0028747 A1* 1/2014 Chappell ..... B41J 11/0015 347/12
2014/0290571 A1* 10/2014 Toya ..... B41J 15/04 118/68
2015/0022601 A1* 1/2015 Ohnishi ..... B41J 11/002 347/102

FOREIGN PATENT DOCUMENTS

JP 2011-218678 A 11/2011
JP 2012-020548 A 2/2012
JP 2012-076227 A 4/2012

OTHER PUBLICATIONS

The Extended European Search Report for the corresponding European Application No. 15198736.9 dated Apr. 20, 2016.

* cited by examiner

*Primary Examiner* — Henok Legesse
(74) *Attorney, Agent, or Firm* — Global IP Counselors, LLP

(57) ABSTRACT

A drying apparatus includes: a heat drying section that heats a medium to which a liquid has been applied from a first surface side of the medium; a temperature adjusting section that adjusts a temperature of the medium from a second surface side of the medium, the second surface being on the opposite side to the first surface; and a control section capable of controlling the heat drying section and the temperature adjusting section. The control section controls the heat drying section and the temperature adjusting section individually in accordance with the type of the medium.

20 Claims, 5 Drawing Sheets

Tb

| CLASS | M1 | M2 | M3 |
|---|---|---|---|
| HEAT RESISTANCE | LOW | MEDIUM | HIGH |
| TEMPERATURE Tfa | T1 | T2 | T3 |
| TEMPERATURE Tfb | T4 | T5 | T6 |
| TEMPERATURE DIFFERENCE Tc | LARGE | MEDIUM | SMALL |

Tba

| CLASS | M1 | M2 | M3 |
|---|---|---|---|
| HEAT RESISTANCE | LOW | MEDIUM | HIGH |
| TEMPERATURE Tfa | T1a | T1a | T1a |
| TEMPERATURE Tfb | T4 | T5 | T6 |
| TEMPERATURE DIFFERENCE Tc | LARGE | MEDIUM | SMALL |

DRYING APPARATUS, PRINTING APPARATUS, AND DRYING METHOD WITH TEMPERATURE ADJUSTMENT OF MEDIUM

BACKGROUND

1. Technical Field

The present invention relates to techniques for drying a medium to which a liquid has been applied.

2. Related Art

In past printing apparatuses, a technique is known in which ink is applied to a printing material wound in a roll shape while transporting that printing material (see JP-A-2012-76227, JP-A-2011-218678, and JP-A-2012-20548, for example). According to the techniques of JP-A-2012-76227, JP-A-2011-218678, and JP-A-2012-20548, a drying unit for drying the ink applied to the printing material is provided in order to prevent the ink applied to the printing material from adhering to other members in the printing apparatus (transport rollers, for example).

To dry ink in a printing apparatus, it is necessary to use such a drying unit to introduce, to the ink, an amount of heat sufficient to evaporate the moisture from the ink. Here, various types of printing materials having different heat resistances may be used in the printing apparatus. Various problems can therefore arise in the case where a temperature used by the drying unit for drying the ink is controlled to a set temperature. For example, in the case where the printing material used in the printing apparatus has a low heat resistance and the temperature of the drying unit has been controlled to a set temperature based on that printing material, that controlled drying temperature will be lower than a maximum drying temperature that can actually be used for a high-heat resistance printing material, resulting in slower drying for the high-heat resistance printing material. On the other hand, in the case where the printing material used in the printing apparatus has a high heat resistance and the temperature of the drying unit has been controlled to a set temperature based on that printing material, a low-heat resistance printing material may be damaged by the heat.

The stated problems are not limited to techniques for drying ink applied to a printing material, and can arise in any technique for drying a medium to which a liquid has been applied.

SUMMARY

Having been conceived in order to solve at least part of the aforementioned problems, the invention can be implemented as the following aspects.

1. One aspect of the invention provides a drying apparatus. This drying apparatus includes: a heat drying section that heats a medium to which a liquid has been applied from a first surface side of the medium; a temperature adjusting section that adjusts a temperature of the medium from a second surface side of the medium, the second surface being on the opposite side to the first surface; and a control section capable of controlling the heat drying section and the temperature adjusting section. The control section controls the heat drying section and the temperature adjusting section individually in accordance with the type of the medium.

According to this aspect, the heat drying section and the temperature adjusting section are controlled individually in accordance with the type of the medium, and thus the liquid applied to various media can be dried appropriately.

2. In the drying apparatus according to the above aspect, the control section may control the heat drying section and the temperature adjusting section individually based on a set that includes a first target value indicating a target temperature value for the first surface side and a second target value indicating a target temperature value for the second surface side and that is different depending on the type of the medium.

According to this aspect, the heat drying section and the temperature adjusting section are controlled individually based on sets that differ in accordance with the type of the medium, and thus the liquid applied to various media can be dried appropriately.

3. In the drying apparatus according to the above aspect, the control section may control the temperature adjusting section so that an amount of heat outputted from the temperature adjusting section to the medium is lower when using a second medium having a lower glass transition point than a first medium than when using the first medium as the medium.

According to this aspect, setting the amount of heat outputted from the temperature adjusting section to the medium to be lower when using the second medium having the lower glass transition point than when using the first medium makes it possible to reduce the likelihood of a low-heat resistance medium being damaged by the heat.

4. In the drying apparatus according to the above aspect, the control section may control the heat drying section and the temperature adjusting section so that a difference between an amount of heat outputted from the heat drying section to the medium and an amount of heat outputted from the temperature adjusting section to the medium is greater when using a second medium having a lower glass transition point than a first medium than when using the first medium as the medium.

According to this aspect, setting the difference between the heat amounts to be greater when using the second medium than when using the first medium makes it possible to ensure that heat escapes from one side of the second medium (for example, the second surface side) even in the case where the other side of the second medium (for example, the first surface side) has been heated. This makes it possible to ensure that heat escapes from the one side while heating the medium with an amount of heat required to dry the liquid from the other side, which makes it possible to reduce the likelihood of a low-glass transition point medium being damaged by the heat while also drying the liquid in a short amount of time.

5. The drying apparatus according to the above aspect may further include a control table that defines, on a medium type-by-medium type basis, amounts of heat applied to the medium by the heat drying section and the temperature adjusting section, and the control section may control operations of the heat drying section and the temperature adjusting section by referring to the control table.

According to this aspect, appropriate drying can be carried out in accordance with the type of the medium by referring to the control table.

6. In the drying apparatus according to the above aspect, the heat drying section may dry the medium using the same output regardless of the type of the medium.

According to this aspect, the control of the heat drying section can be simplified.

7. In the drying apparatus according to the above aspect, the temperature adjusting section may include a cooling device for cooling the second surface of the medium.

According to this aspect, the second surface of the medium can be cooled by the cooling device, and thus damage to the medium caused by heat can be reduced.

8. In the drying apparatus according to the above aspect, the control section may control the temperature adjusting section so that a temperature on the second surface side is lower when using a second medium having a lower glass transition point than a first medium than when using the first medium as the medium.

According to this aspect, more heat can be caused to escape from the first surface side toward the second surface side when using the low-glass transition point second medium, and thus the likelihood of the temperature of the medium becoming excessively high can be reduced. Through this, the likelihood of the medium being damaged by heat can be reduced while ensuring that the heat drying section applies the required amount of heat to dry the liquid applied to the medium.

9. In the drying apparatus according to the above aspect, the control section may control the heat drying section and the temperature adjusting section so that a temperature on the first surface side is greater than or equal to a temperature on the second surface side and so that a difference between the temperature on the first surface side and the temperature on the second surface side is greater when using a second medium having a lower glass transition point than a first medium than when using the first medium as the medium.

According to this aspect, more heat can be caused to escape from the first surface side toward the second surface side when using the low-glass transition point second medium, and thus the likelihood of the temperature of the medium becoming excessively high can be reduced. Through this, the likelihood of the medium being damaged by heat can be reduced while ensuring that the heat drying section applies the required amount of heat to dry the liquid applied to the medium. In addition, the amount of heat escaping from the first surface side to the second surface side can be suppressed when using the high-glass transition point first medium, and thus the heat applied to the first surface from the heat drying section can be used efficiently in the drying of the liquid.

10. In the drying apparatus according to the above aspect, the temperature adjusting section may include a cylindrical support portion having a circumferential surface upon which the medium can be wrapped and an adjustment mechanism section that adjusts a temperature of the circumferential surface; and the heat drying section and the temperature adjusting section may dry the medium in a state where the medium is wrapped upon the circumferential surface.

By carrying out the drying with the medium wrapped on the support portion, the likelihood of the medium deforming due to the heat can be reduced.

11. Another aspect of the invention provides a printing apparatus. This printing apparatus includes an ejecting section for ejecting a liquid onto a medium and the drying apparatus according to the above aspect.

According to this aspect, the heat drying section and the temperature adjusting section are controlled individually in accordance with the type of the medium, and thus the liquid applied to various media can be dried appropriately.

12. Another aspect of the invention provides a method of drying a medium to which a liquid has been applied. This drying method includes: heating and drying a medium to which a liquid has been applied from a first surface side of the medium; and adjusting a temperature of the medium from a second surface side of the medium, the second surface being on the opposite side to the first surface. The heating and drying of the medium and the adjusting of the temperature of the medium are executed individually in accordance with the type of the medium.

According to this aspect, the heating and drying of the medium and the adjusting of the temperature of the medium are executed individually in accordance with the type of the medium, and thus the liquid applied to various media can be dried appropriately.

Note that in addition to a drying apparatus, a printing apparatus, and a drying method, the invention can be realized as the following modes; a control method for a drying apparatus or a printing apparatus, a computer program for realizing that control method, a non-transitory recording medium on which that computer program is recorded, a medium such as a printing material manufactured using the stated apparatuses or methods, and so on.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
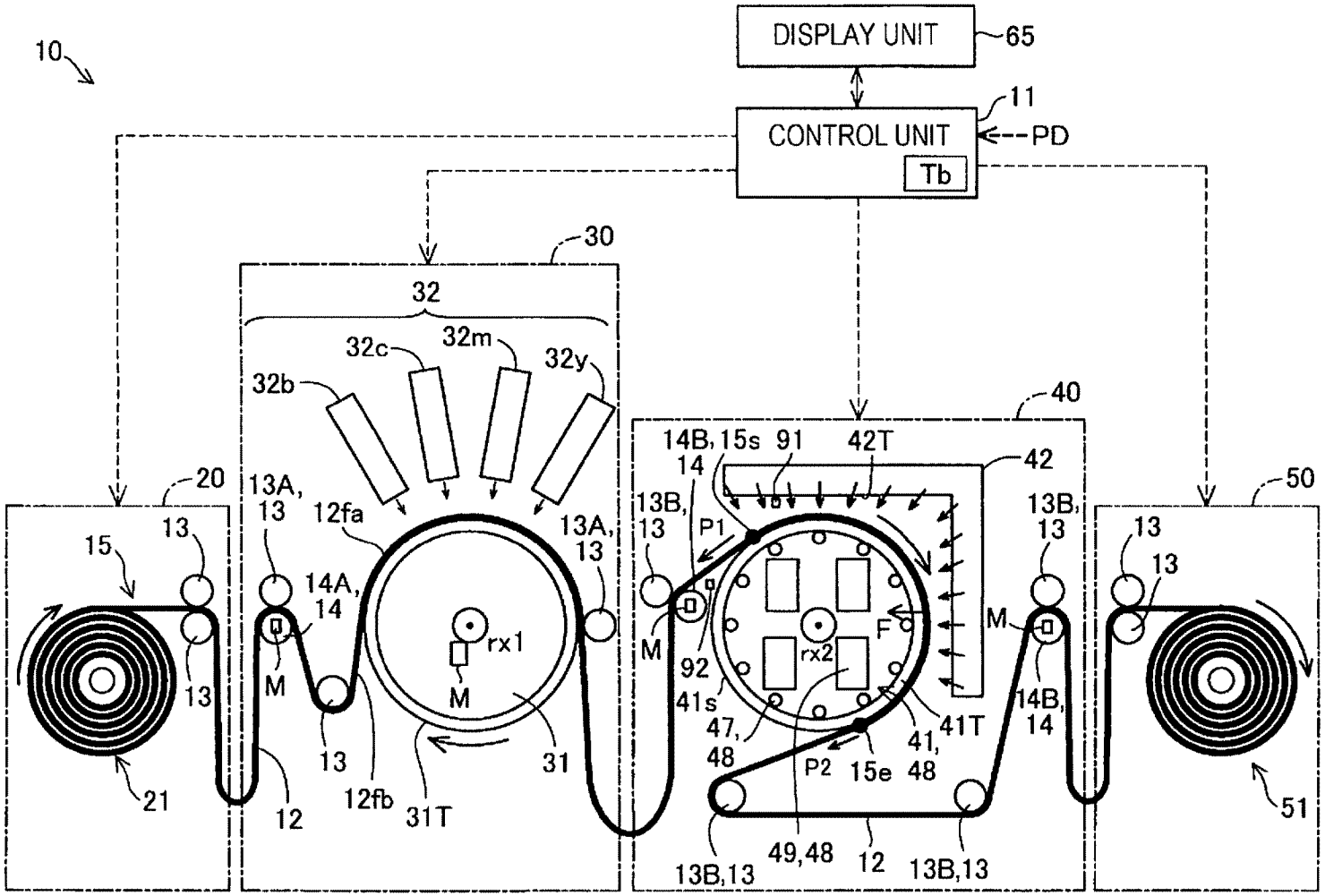
FIG. 1 is a schematic diagram illustrating a printing apparatus according to a first embodiment of the invention.
Figures 2, 3:
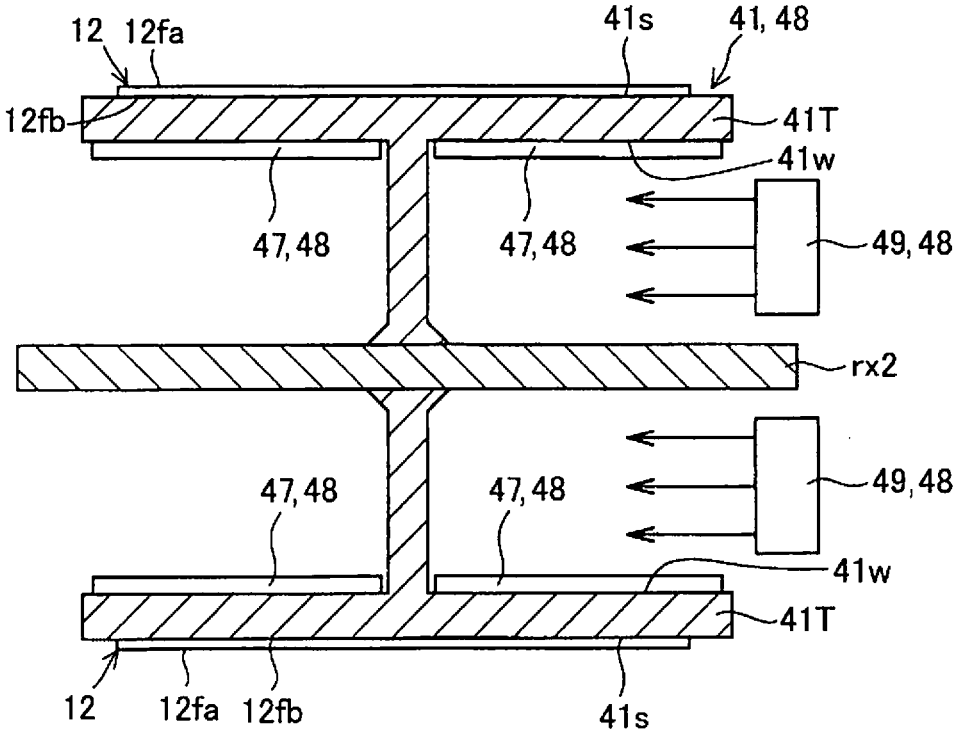
FIG. 2 is a diagram illustrating a temperature adjusting section.
FIG. 3 is a diagram illustrating a control table used by a control section.

FIG. 1 is a schematic diagram illustrating a printing apparatus 10 serving as a first embodiment of the invention. FIG. 2 is a diagram illustrating a temperature adjusting section 48. FIG. 2 is a schematic diagram illustrating a cross-section of a transport drum 41 along a plane that passes through a rotational axis rx2 and is parallel to the rotational axis rx2. The printing apparatus 10 (FIG. 1) according to this embodiment is an ink jet line printer that forms an image by applying ink droplets to a printing material 12 serving as a medium. The printing apparatus 10 prints continuously onto the printing material 12, which is band-shaped and is transported in a lengthwise direction. The type of the printing material 12 is not particularly limited, and glossy paper, coated paper, OHP film, ink jet paper, standard paper, Japanese paper, cloth, and so on may be used as the printing material 12, for example. The printing material 12 may be constituted of a single layer, or may be constituted by a plurality of different types of layers laminated together.

The printing apparatus 10 includes a control section 11, a plurality of transport rollers 13, a plurality of driving rollers 14, a display unit 65, a material feed-out unit 20, a liquid applying unit 30, a drying unit 40 serving as a drying apparatus, and a material take-up unit 50. The plurality of transport rollers 13 and the plurality of driving rollers 14 can be taken as constituent elements of the material feed-out unit 20, the liquid applying unit 30, the drying unit 40, and the material take-up unit 50. The display unit 65 is a unit for displaying various types of information such as operating states and the like. The display unit 65 is a touch panel, and also has a function for accepting inputs from a user. The control section 11 is constituted of a microcomputer including a central processing unit and a main storage unit, and is capable of controlling the various constituent elements of the printing apparatus 10. The control section 11 obtains print data PD from an externally-connected computer and executes a printing process based on that print data PD in response to a command from the user. The print data PD, which serves as image data, may be document data in which text and graphics are laid out, raster data such as a photographic image, data expressing images created through various types of application programs, and so on, for example. A control table Tb is stored in the control section 11. The control table Tb is a table for defining respective operating conditions (temperature conditions, for example) of a heat drying section 42 and the temperature adjusting section 48, which will be described later. Referring to the control table Tb, the control section 11 controls the respective operations of the heat drying section 42 and the temperature adjusting section 48 individually in accordance with the heat resistance of the printing material 12.

The plurality of transport rollers 13 and the plurality of driving rollers 14 constitute, in the printing apparatus 10, a transport path 15 that transports the printing material 12 in the lengthwise direction. The plurality of transport rollers 13 and the plurality of driving rollers 14 are disposed so that the material feed-out unit 20, the liquid applying unit 30, the drying unit 40, and the material take-up unit 50 are connected by the transport path 15 in that order. Hereinafter, the material feed-out unit 20 side of the transport path 15 will be called an "upstream side", and the material take-up unit 50 side of the transport path 15 will be called a "downstream side". The transport rollers 13 are slave rollers that do not have drive sources such as motors. Each of the driving rollers 14 has a motor M, and the rotational operation of the driving rollers 14 is controlled by driving the motors M in accordance with signals from the control section 11.

Here, of the transport rollers 13 and driving rollers 14 in the transport path 15, from the downstream side of a print head section 32 to a point where drying by the drying unit 40 ends (a post-liquid application transport path), it is preferable that the rollers disposed on a first surface 12*fa* side, which corresponds to a liquid application surface, have the following configuration. It is preferable that the transport rollers 13 disposed on the first surface 12*fa* side in the post-liquid application transport path be configured such that nip locations (contact locations) for the printing material 12 are in areas on both sides of the printing material 12 in the width direction thereof (in other words, are in areas outside of a region that is printed onto). Doing so makes it possible to suppress undried ink applied to the printing material 12 from making contact with the transport rollers 13, which in turn makes it possible to suppress a drop in the quality of the printed image formed on the printing material 12.

The material feed-out unit 20 includes a material roller 21 upon which the printing material 12 is wound in roll shape. The material roller 21 is rotated at a predetermined rotational speed by a motor (not shown) controlled by the control section 11, and the printing material 12 is fed out from the material roller 21 to the liquid applying unit 30.

The liquid applying unit 30 includes a transport drum 31, the print head section 32 serving as a liquid applying section, a driving roller 14A, and a plurality of transport rollers 13A. The liquid applying unit 30 forms an image by applying ink to the first surface 12*fa* of the printing material 12, the first surface 12*fa* being located on a side that opposes the print head section 32. The transport drum 31 includes a motor M, and a support portion 31T that forms a circumferential surface of the transport drum 31 is rotated at a predetermined rotational speed by the motor M. The support portion 31T of the transport drum 31 makes surface contact with a second surface 12*fb* of the printing material 12, on the opposite side to the first surface 12*fa*, and transports the printing material 12 while supporting the printing material 12. In other words, the transport drum 31 forms a part of the transport path 15. The transport drum 31, the driving roller 14A, and the plurality of transport rollers 13A provided in the liquid applying unit 30 are configured to be capable of imparting tension, in the lengthwise direction, on the printing material 12 supported on the support portion 31T of the transport drum 31.

The print head section 32 applies ink to the printing material 12 transported by the transport drum 31, the driving roller 14A, and the transport rollers 13A. The print head section 32 includes four types of liquid ejecting heads 32*b*, 32*c*, 32*m*, and 32*y*. The liquid ejecting heads 32*b* to 32*y* are line heads, and eject liquid droplets toward the printing material 12 at timings and sizes specified by commands from the control section 11. When traversing the print head section 32, a printed image is formed on the first surface 12*fa* of the printing material 12, which is the surface of the printing material 12 that opposes the liquid ejecting heads 32*b* to 32*y*, as a result of the liquid ejecting heads 32*b* to 32*y* ejecting liquid droplets. The liquid ejecting heads 32*b* to 32*y* are arranged in a radial shape relative to a rotational axis rx1 of the transport drum 31 with nozzles thereof oppose the support portion 31T of the transport drum 31, so that the liquid droplets from the respective heads can be applied to a printing region of the printing material 12. In other words, in the printing apparatus 10 according to this embodiment, the transport drum 31 functions as a so-called platen.

The first liquid ejecting head 32*b* ejects a black ink. The second liquid ejecting head 32*c* ejects a cyan color ink. The third liquid ejecting head 32*m* ejects a magenta color ink. The fourth liquid ejecting head 32*y* ejects a yellow color ink. Each ink is a water-based ink that takes water as its primary carrier (for example, a water-based pigment ink). Note that other types of ink (for example, a dye-based ink, an ink that uses an organic carrier as a carrier for pigment, or the like) may be used for each ink instead of a water-based pigment ink.

The drying unit 40 includes the transport drum 41 serving as a guide, the heat drying section 42, the temperature adjusting section 48 that includes the transport drum 41, two driving rollers 14B, a plurality of transport rollers 13B, a first temperature sensor 91, and a second temperature sensor 92. The transport drum 41 has a cylindrical support portion 41T, and the support portion 41T rotates central to the rotational axis rx2 in accordance with the transport of the printing material 12. The support portion 41T of the transport drum 41 is formed of a metal such as stainless steel, for example. An outer circumferential surface 41*s* of the support portion 41T makes surface contact with the second surface 12*fb* of the printing material 12, on the opposite side to the first surface 12*fa*, and supports the printing material 12. In other words, the printing material 12 is wrapped upon a part of the outer circumferential surface 41*s*. In this embodiment, the printing material 12 is wrapped upon approximately half of the outer circumferential surface 41*s* in the circumferential direction thereof. Of the outer circumferential surface 41*s* of the transport drum 41, a point where the surface contact with the printing material 12 begins will be called a contact start point 15*s*, and a point where the surface contact with the printing material 12 ends will be called a contact end point 15*e*. The temperature of the outer circumferential surface 41*s* of the transport drum 41 is adjusted by a heating section 47 and a cooling section 49, which will be described later. The temperature of the second surface 12*fb* of the printing material 12 is adjusted by the second surface lab of the printing material 12 making contact with the outer circumferential surface 41*s* whose temperature has been adjusted. Although the guide that supports the printing material 12 is the support portion 41T of the transport drum 41 in this embodiment, the guide is not limited thereto, and may be any member having a surface capable of supporting the printing material 12. For example, the guide may be a plate-shaped member, a member having a convex curved surface that makes surface contact with the printing material 12, or the like.

The two driving rollers 14B and the plurality of transport rollers 13B transport the printing material 12 to which the ink has been applied by the print head section 32. The two driving rollers 14B are positioned so as to sandwich the transport drum 41 in the transport path 15. The driving rollers 14B and the transport rollers 13B are configured to be capable of imparting tensions P1 and P2, in the lengthwise direction (a transport direction), on the printing material 12 that is on the outer circumferential surface 41*s* of the transport drum 41. Specifically, the tension P1 is imparted on an end portion of the printing material 12 on the contact start point 15*s* side thereof and the tension P2 is imparted on an end portion of the printing material 12 on the contact end point 15*e* side thereof by controlling the rotational speed of the downstream-side driving roller 14B to be faster than the rotational speed of the upstream-side driving roller 14B. In other words, the control section 11 controls the tensions P1 and P2 imparted on the printing material 12 within the drying unit 40 by controlling the rotational speeds of the two driving rollers 14B. A compressive force F that presses the printing material 12 against the outer circumferential surface 41*s* of the transport drum 41 arises as a result of imparting the tensions P1 and P2 on the printing material 12 along the lengthwise direction of the printing material 12.

The heat drying section 42 is provided in a location opposing the outer circumferential surface 41*s* with the printing material 12 therebetween. In other words, the heat drying section 42 is provided on the first surface 12*fa* side of the printing material 12. By heating the first surface 12*fa*, to which the ink has been applied, of the printing material 12 that is in contact with the outer circumferential surface 41*s*, the heat drying section 42 dries the ink. Specifically, the heat drying section 42 uses a fan or the like to blow air heated by a heater (electrical heating wires, for example) onto the first surface 12*fa* of the printing material 12 from an air outlet (nozzle) 42T. As a result, moisture in the ink applied to the first surface 12*fa* of the printing material 12 is heated and evaporates, and the ink on the printing material 12 dries. The heat drying section 42 is configured to be capable of heating the printing material 12 across the entire width thereof. The temperature of the air blown onto the printing material 12 by the heat drying section 42 (that is, the temperature of the air outlet of the heat drying section 42) is set by the control section 11 in accordance with the heat resistance of the printing material 12 (for example, a glass transition point, a heat resistance temperature, a melting point, or the like). It is preferable that the air outlet 42T of the heat drying section 42 have an opening that faces the first surface 12*fa* of the printing material 12 substantially perpendicularly. Furthermore, it is preferable that the air outlet 42T be configured such that the distance between the air outlet 42T and the first surface 12*fa* of the printing material 12 is substantially uniform. Doing so makes it possible to reduce the likelihood of an uneven amount of heat being applied to the first surface 12*fa* of the printing material 12 by the heat drying section 42. A specific method by which the control section 11 controls the heat drying section 42 will be described later.

The temperature adjusting section 48 (FIG. 2) includes the transport drum 41, the heating section 47 serving as a heating device, and the cooling section 49 serving as a cooling device. The heating section 47 is constituted of a plurality of halogen lamps. The plurality of halogen lamps are fixed to an inner circumferential surface 41*w* of the support portion 41T of the transport drum 41, which is on the opposite side of the support portion 41T to the outer circumferential surface 41*s* thereof. The plurality of halogen lamps are disposed at equal intervals along the circumferential direction of the inner circumferential surface 41*w*. The heating section 47 heats the second surface 12*fb* of the printing material 12 that is in contact with the support portion 41T by heating the support portion 41T from the inner circumferential surface 41*w* side thereof. The heating section 47 is configured to be capable of heating the printing material 12 across the entire width thereof through the support portion 41T. The cooling section 49 is a cool air machine that cools the support portion 41T from the inner circumferential surface 41*w* side thereof by sending cool air to the inside of the support portion 41T, which is cylindrical in shape. The second surface 12*fb* of the printing material 12 that is in contact with the support portion 41T is cooled as a result. The cooling section 49 is configured to be capable of cooling the printing material 12 across the entire width thereof through the support portion 41T. As described above, the temperature adjusting section 48 adjusts the temperature of the second surface 12*fb* of the printing material 12. The heating section 47 and the cooling section 49 correspond to an "adjustment mechanism section" described in the summary of the invention.

The first temperature sensor 91 (FIG. 1) is a sensor for detecting the temperature of the air outlet 42T of the heat drying section 42. The second temperature sensor 92 is a sensor for detecting the temperature of a part, located immediately before the contact start point 15*s*, of the outer circumferential surface 41*s* of the support portion 41T that constitutes the temperature adjusting section 48 (that is, a drum surface temperature). The first temperature sensor 91 and the second temperature sensor 92 may be any sensors capable of measuring a temperature to be measured, and may be non-contact temperature sensors such as radiothermometers, contact-type temperature sensors such as thermocouples, or the like, for example. Temperature information detected by the first temperature sensor 91 and the second temperature sensor 92 is outputted to the control section 11.

The material take-up unit 50 includes a take-up roller 51 that is rotationally driven at a predetermined rotational speed in response to a command from the control section 11. The take-up roller 51 takes up the printing material 12 fed out from the drying unit 40. The printing material 12 taken up by the material take-up unit 50 is cut to a predetermined size and used as a product.

FIG. 3 is a diagram illustrating the control table Tb held in the control section 11. A temperature Tfa, which is a first surface 12*fa*-side target temperature value, and a temperature Tfb, which is a second surface 12*fb*-side target temperature value, are set in the control table Tb, in accordance with the type (heat resistance) of the printing material 12.

The temperature Tfa is the temperature detected by the first temperature sensor 91 (FIG. 1). In other words, in this embodiment, the temperature Tfa is the temperature of the air outlet 42T (FIG. 1). The temperature Tfb is the temperature detected by the second temperature sensor 92. In other words, the temperature Tfb is the temperature of the part, immediately before the contact start point 15*s*, of the outer circumferential surface 41*s* of the support portion 41T. Here, the temperature Tfa corresponds to a "first target value" described in the summary of the invention, and the temperature Tfb corresponds to a "second target value" described in the summary of the invention. Note that the temperature Tfa may be a temperature at an intermediate point on the first surface 12*fa* of the printing material 12 between the contact start point 15*s* and the contact end point 15*e*, in the transport direction. In this case, the first temperature sensor 91 detects the temperature of the intermediate point of the first surface 12*fa*. Meanwhile, the temperature Tfb may be a temperature at an intermediate point on the second surface 12*fb* of the printing material 12 between the contact start point 15*s* and the contact end point 15*e*, in the transport direction. In this case, the second temperature sensor 92 detects the temperature of the intermediate point of the second surface 12*fb*.

The printing material 12 is classified into one of three types. A class M1 is a printing material 12 having a low heat resistance, a class M2 is a printing material 12 having a medium heat resistance, and a class M3 is a printing material 12 having a high heat resistance. The degree of heat resistance can be compared based on a glass transition point, a heat resistance temperature, a melting point, or the like, which serves as an index expressing the heat resistance, for example. In this embodiment, the glass transition point increases in order from the class M1, to the class M2, and to the class M3. Based on input information regarding the heat resistance of the printing material 12 inputted by the user via the display unit 65 (for example, the material that constitutes the printing material 12), the control section 11 refers to a table (not shown) that defines relationships between materials and glass transition points, and classifies the printing material 12 into one of the classes M1 to M3. For example, the printing material 12 is classified into the class M1 in the case where the printing material 12 is polyethylene, into the class M2 in the case where the printing material 12 is polypropylene, and into the class M3 in the case where the printing material 12 is polyethylene terephthalate.

In the control table Tb, the first surface 12*fa*-side temperature Tfa is set to temperatures T1 to T3 and the second surface 12*fb*-side temperature Tfb is set to temperatures T4 to T6 for each of the classes M1 to M3. In other words, sets of the temperature Tfa and the temperature Tfb are set in the control table Tb so as to differ depending on the heat resistance of the printing material 12 (the classes M1 to M3). The temperatures T1 to T6 are all different temperatures. The control section 11 refers to the control table Tb and controls the operations of the heat drying section 42 and the temperature adjusting section 48 (and specifically, the heating section 47 and the cooling section 49) to attain the temperatures to which the temperature Tfa and the temperature Tfb have been set. A relationship of temperature T1<temperature T2<temperature T3 holds true for the temperature Tfa. Likewise, a relationship of temperature T4<temperature T5<temperature T6 holds true for the temperature Tfb. Furthermore, a relationship of temperature Tfa temperature Tfb holds true for each class. In other words, the control section 11 controls the operations of the heat drying section 42 and the temperature adjusting section 48 so that the temperature Tfa on the first surface 12*fa* side, where the ink has been applied, becomes higher than the temperature Tfb on the second surface 12*fb*, which is on the side opposite to the first surface 12*fa*. Meanwhile, the temperatures T1 to T6 are set so that in each class, a temperature difference Tc, which is a difference between the temperature Tfa and the temperature Tfb (=Tfa−Tfb), decreases as the classes progress from the class M1, whose heat resistance is low, to the class M3, whose heat resistance is high. As described above, the control table Tb is a table that defines amounts of heat applied to the printing material 12 by the heat drying section 42 and the temperature adjusting section 48 for each heat resistance of the printing material 12. It is preferable that the temperatures T1 to T3 be set to a range that is, for example, near the boiling point of water (the carrier) (100° C., for example) and that enables damage (deformation or the like) to the printing material 12 caused by the heat to be suppressed. For example, the temperatures T1 to T3 may be set to a range of 80° C. to 120° C. Meanwhile, the temperatures T4 to T6 may be set to be lower than the corresponding temperatures T1 to T3 by a range of 20° C. to 60° C. In addition, the temperature difference Tc may increase progressively in a range of 5° C. to 25° C. in order from the class M1, to the class M2, and to the class M3. For example, in the case where the temperature difference Tc of the class M1 is 60° C., the temperature difference Tc of the class M2 may be 40° C., and the temperature difference Tc of the class M3 may be 20° C. Note that the air flow of the heat drying section 42 is constant for all of the classes M1 to M3. In this manner, a process of heating and drying the printing material 12 from the first surface 12*fa* side of the printing material 12 and a process of adjusting the temperature of the printing material 12 from the second surface 12*fb* side thereof are executed individually based on sets of the temperature Tfa, which is the first surface 12*fa* side target temperature value, and the temperature Tfb, which is the second surface 12*fb* side target temperature value, that differ depending on the heat resistance of the printing material 12.

Figure 4:
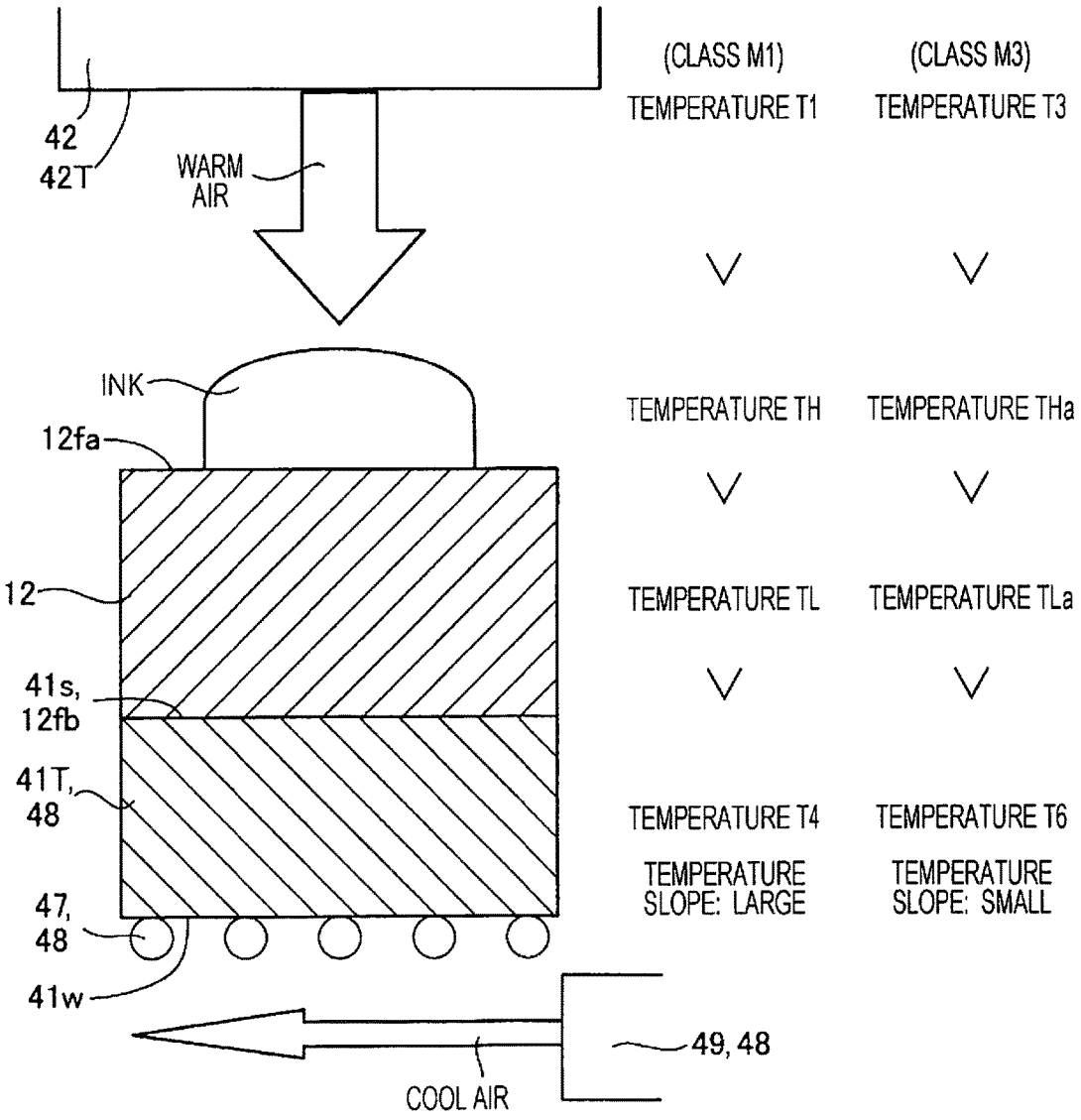
FIG. 4 is a diagram illustrating an effect.

FIG. 4 is a diagram illustrating an effect. In the case where the class M1 printing material 12, whose heat resistance is low, is used, the control section 11 refers to the control table Tb and controls the operation of the heat drying section 42 so that the temperature Tfa of the air outlet 42T (the first surface 12*fa* side temperature) becomes a temperature T1. Meanwhile, the control section 11 refers to the control table Tb and controls the operation of the temperature adjusting section 48 so that the drum surface temperature Tfb (the second surface 12*fb* side temperature) becomes a temperature T4 that is lower than the temperature T1. Here, when the class M1 printing material 12 is used, the ambient temperature near the first surface 12*fa* is a temperature TH, and the temperature (average temperature) of the printing material 12 is a temperature TL. In this case, the temperature difference Tc (=temperature T1−temperature T4) is greatest for the class M1, and thus a temperature slope between the air outlet 42T and the outer circumferential surface 41*s* in the thickness direction of the printing material 12 (the up-down direction in FIG. 4) increases. In other words, a relationship of temperature T1>temperature TH>temperature TL>temperature T4 holds true. Through this, the heat introduced to the printing material 12 can escape to the support portion 41T side via the second surface 12*fb* while ensuring that the heat drying section 42 applies an amount of heat sufficient to evaporate the moisture within the ink. Accordingly, the likelihood that a low-heat resistance printing material 12 will be damaged by the heat can be reduced while advancing the evaporation of the moisture within the ink.

On the other hand, in the case where the class M3 printing material 12, whose heat resistance is high, is used, the control section 11 refers to the control table Tb and controls the operation of the heat drying section 42 so that the temperature Tfa of the air outlet 42T (the first surface 12*fa* side temperature) becomes a temperature T3. Meanwhile, the control section 11 refers to the control table Tb and controls the operation of the temperature adjusting section 48 so that the drum surface temperature Tfb (the second surface 12*fb* side temperature) becomes a temperature T6 that is lower than the temperature T3. Here, when the class M3 printing material 12 is used, the ambient temperature near the first surface 12*fa* is a temperature THa, and the temperature (average temperature) of the printing material 12 is a temperature TLa. In this case, the temperature difference Tc (=temperature T3−temperature T6) is lower than for the class M1. Accordingly, although a relationship of temperature T1>temperature TH>temperature TL>temperature T4 holds true, the temperature slope between the air outlet 42T and the outer circumferential surface 41*s* in the thickness direction of the printing material 12 (the up-down direction in FIG. 4) decreases. In other words, the heat introduced to the printing material 12 can be suppressed from escaping to the support portion 41T side via the second surface 12*fb* while ensuring that the heat drying section 42 applies the required amount of heat to evaporate the moisture within the ink. Through this, the heat applied to the first surface 12*fa* from the heat drying section 42 can be used efficiently to evaporate the moisture within the ink. In the case of the class M3, to suppress the escape of heat to the support portion 41T side to the greatest extent possible, it is preferable that the temperature difference Tc between the temperature T3 and the temperature T6 in the control table Tb be set to no greater than 30° C., further preferable that the temperature difference Tc be set to no greater than 20° C., and still further preferable that the temperature difference Tc be set to no greater than 10° C.

As described above, in this embodiment, the heat drying section 42 and the temperature adjusting section 48 are each controlled individually in accordance with the heat resistance of the printing material 12, and thus the ink applied to various printing materials 12 having different heat resistances can be dried appropriately.

As illustrated in FIG. 3, in the foregoing embodiment, the control section 11 controls the operation of the temperature adjusting section 48 so that the amount of heat outputted to the printing material 12 from the temperature adjusting section 48 is lower when using a second medium (the class M1 printing material 12, for example), whose glass transition point serving as an index expressing the heat resistance is lower than a first medium, than when using the first medium (the class M3 printing material 12, for example) as the printing material 12. To rephrase, the heating section 47 and the cooling section 49 of the temperature adjusting section 48 are controlled so that the temperature Tfb of the outer circumferential surface 41*s*, which is a member that makes contact with the second surface 12*fb* of the printing material 12, is lower for the class M1 printing material 12 than for the class M3 printing material 12, for example (temperature T4<temperature T6). This makes it possible to reduce the likelihood that a low-heat resistance printing material 12 will be damaged by the heat.

In addition, as illustrated in FIG. 3, in the foregoing embodiment, the control section 11 controls the respective operations of the heat drying section 42 and the temperature adjusting section 48 so that a difference between the amount of heat outputted to the printing material 12 from the heat drying section 42 and the amount of heat outputted to the printing material 12 from the temperature adjusting section 48 is greater when using the second medium (the class M1 printing material 12, for example), whose glass transition point is lower than the first medium, than when using the first medium (the class M3 printing material 12, for example) as the printing material 12. To rephrase, the control section 11 controls the respective operations of the heat drying section 42 and the temperature adjusting section 48 (and specifically, the heating section 47 and the cooling section 49) so that the temperature difference Tc is greater for the class M1 printing material 12 than for the class M3 printing material 12, for example. Through this, in the case where a low-heat resistance printing material 12 is used, more heat can escape from the second surface 12*fb* side, even in the case where the first surface 12*fa* side of the printing material 12 has been heated by the heat drying section 42. As a result, a negative amount of heat can be applied to the printing material 12 from the second surface 12*fb*, enabling heat to escape, while the heat drying section 42 applies the amount of heat required to dry the ink from the first surface 12*fa* side of the printing material 12; this makes it possible to reduce the likelihood of the printing material 12 being damaged by the heat while drying the ink in a shorter amount of time, even in the case where a low-heat resistance printing material 12 is used.

In addition, as illustrated in FIGS. 1 and 3, according to the foregoing embodiment, the control section 11 includes the control table Tb, which defines the amount of heat applied to the printing material 12 by the heat drying section 42 and the temperature adjusting section 48 for each heat resistance of the printing material 12. The control section 11 controls the operations of the heat drying section 42 and the temperature adjusting section 48 by referring to the control table Tb. Accordingly, by referring to the control table Tb, the control section 11 can ensure that ink is dried appropriately in accordance with the heat resistance of the printing material 12.

In addition, as illustrated in FIG. 1, in the foregoing embodiment, the temperature adjusting section 48 includes the support portion 41T, which has the outer circumferential surface 41*s* that is a circumferential surface, and the ink is dried using the heat drying section 42 and the temperature adjusting section 48 in a state where the printing material 12 is wrapped upon on the outer circumferential surface 41*s* of the support portion 41T. Accordingly, the apparent rigidity of the printing material 12 can be increased, and thus the likelihood of the printing material 12 deforming due to heat can be reduced.

In addition, as illustrated in FIG. 2, the temperature adjusting section 48 includes the cooling section 49 for cooling the second surface 12*fb* of the printing material 12. The second surface 12*fb* of the printing material 12 can therefore be cooled by the cooling section 49, and thus damage to the printing material 12 caused by heat can be reduced. Here, the cooling section 49 cools the support portion 41T that makes contact with the second surface 12*fb*, and the second surface 12*fb* is cooled via the support portion 41T, and thus the cooling section 49 and the support portion 41T can be taken together as a cooling device.

Second Embodiment

Figure 5:
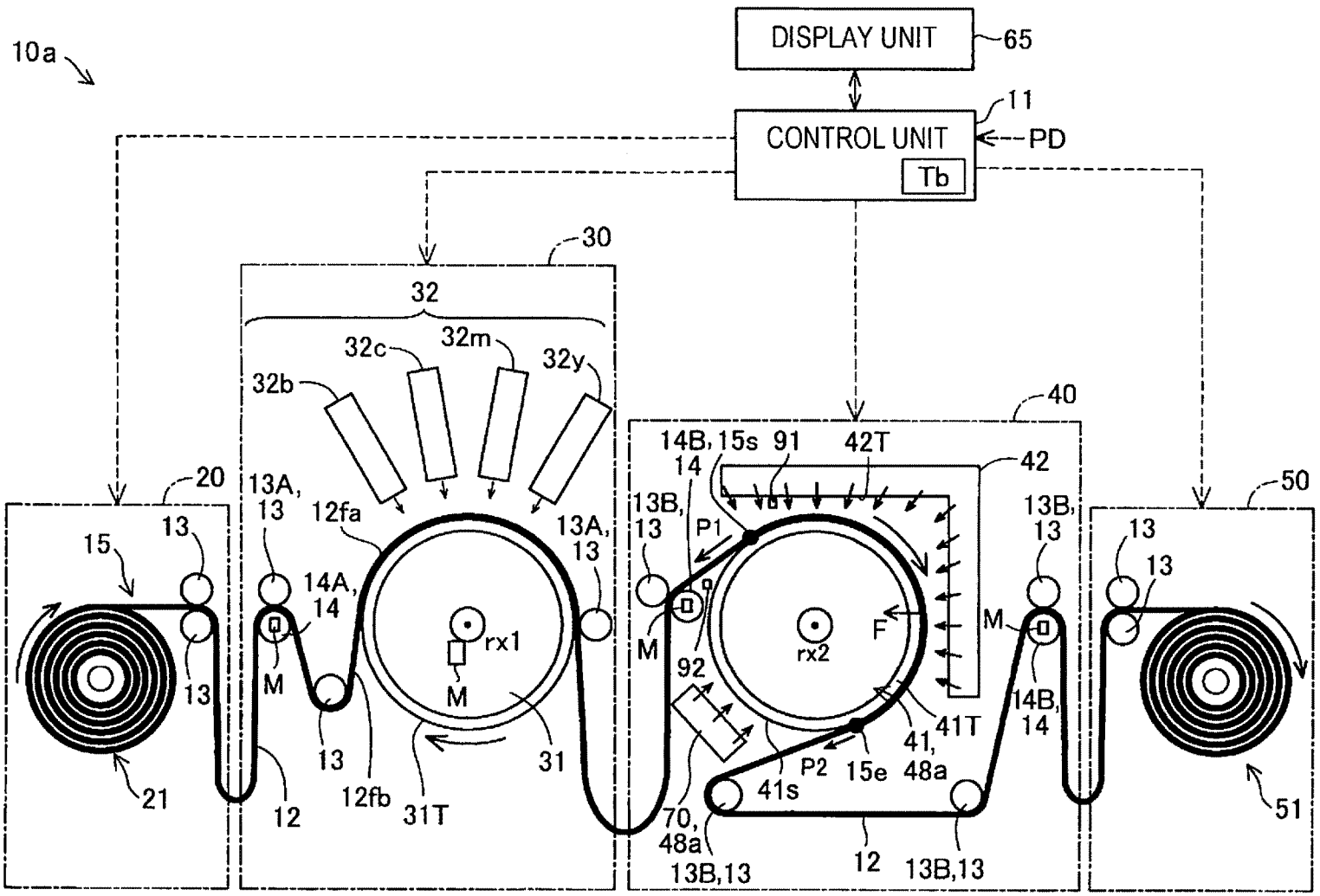
FIG. 5 is a schematic diagram illustrating a printing apparatus according to a second embodiment of the invention.

FIG. 5 is a schematic diagram illustrating a printing apparatus 10*a* serving as a second embodiment of the invention. The printing apparatus 10 of the first embodiment and the printing apparatus 10*a* of the second embodiment differ in terms of the constituent elements of the temperature adjusting section 48 that heat and cool the support portion 41T (the heating section 47 and the cooling section 49 illustrated in FIG. 2, in the first embodiment). Other configurations are the same as in the first embodiment, and thus like reference numerals will be applied to like elements and descriptions thereof will be omitted.

A temperature adjusting section 48*a* of a drying unit 40*a* in the second embodiment includes a heating/cooling section 70 that serves as an adjustment mechanism section, instead of the heating section 47 and the cooling section 49 (FIG. 2). This heating/cooling section 70 heats and cools parts of the outer circumferential surface 41*s* aside from the part from the contact start point 15*s* to the contact end point 15*e* (that is, parts not in contact with the printing material 12). The heating/cooling section 70 blows warm air on the outer circumferential surface 41*s* when heating the outer circumferential surface 41*s* and blows cool air on the outer circumferential surface 41*s* when cooling the outer circumferential surface 41*s*. The control section 11 controls the operation of the heating/cooling section 70 so that a specific part of the outer circumferential surface 41*s* (a part immediately before the contact start point 15*s*) attains the temperature Tfb in the control table Tb (FIG. 3).

According to the foregoing second embodiment, the same effects as the first embodiment can be achieved. For example, the heat drying section 42 and the temperature adjusting section 48*a* are each controlled individually in accordance with the heat resistance of the printing material 12, and thus the ink applied to various printing materials 12 having different heat resistances can be dried appropriately.

Third Embodiment

Figures 6, 7:
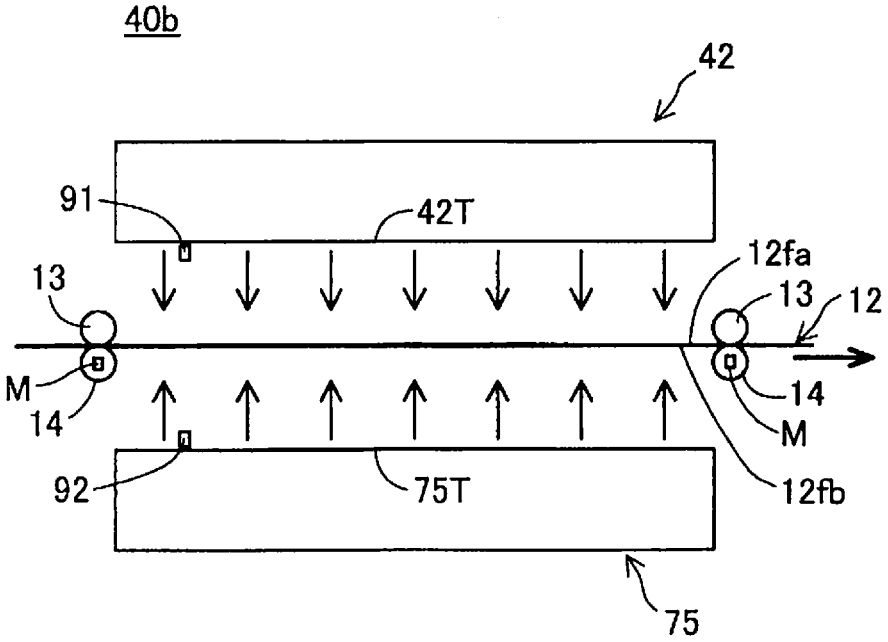
FIG. 6 is a diagram illustrating a drying unit according to a third embodiment.
FIG. 7 is a diagram illustrating a control table according to another embodiment.

FIG. 6 is a diagram illustrating a drying unit 40*b* according to a third embodiment. The printing apparatus 10 may employ the drying unit 40*b* of the third embodiment instead of the drying unit 40 (FIG. 1). The drying unit 40*b* of the third embodiment does not include the transport drum 41, and transports the printing material 12 using the transport rollers 13 and the driving rollers 14. A first drying section 42, serving as a heat drying section, is provided on the first surface 12*fa* side of the printing material 12, and blows heated air onto the first surface 12*fa*. A second drying section 75, serving as a temperature adjusting section, is provided on the opposite side to the first drying section 42 with the printing material 12 therebetween. The second drying section 75 blows heated air onto the second surface 12*fb*. Note that the second drying section 75 may have a function for blowing cool air as well. The first temperature sensor 91 is a sensor for detecting the temperature of an air outlet 42T of the first drying section 42. The second temperature sensor 92 is a sensor for detecting the temperature of an air outlet 75T of the second drying section 75. Temperature information detected by the first temperature sensor 91 and the second temperature sensor 92 is outputted to the control section 11 (FIG. 1). In other words, the temperature Tfa in the control table Tb (FIG. 3) is a temperature detected by the first temperature sensor 91, and the temperature Tfb is a temperature detected by the second temperature sensor 92.

As in the first embodiment, referring to the control table Tb, the control section 11 controls the respective operations of the first drying section 42 and the second drying section 75 individually in accordance with the heat resistance of the printing material 12. For example, in the case where a printing material 12 classified into the class M1 of the control table Tb is used, the operation of the first drying section 42 is controlled so that the temperature Tfa becomes the temperature T1 based on the temperature information from the first temperature sensor 91, and the operation of the second drying section 75 is controlled so that the temperature Tfb becomes the temperature T4 based on the temperature information from the second temperature sensor 92. Note that the air flow of the first drying section 42 is constant and the air flow of the second drying section 75 is constant, regardless of the classes M1 to M3 of the printing material 12.

According to the foregoing third embodiment, the same effects as the first embodiment can be achieved with respect to the points where the configuration is the same as in the first embodiment. For example, the first drying section 42 and the second drying section 75 are each controlled individually in accordance with the heat resistance of the printing material 12, and thus the ink applied to various printing materials 12 having different heat resistances can be dried appropriately. In addition, the control section 11 controls the operation of the second drying section 75 so that the amount of heat per unit of surface area outputted to the printing material 12 from the second drying section 75 is lower when using the second medium (the class M1 printing material 12, for example), whose glass transition point serving as an index expressing the heat resistance is lower than a first medium, than when using the first medium (the class M3 printing material 12, for example) as the printing material 12. To rephrase, the temperature Tfb of the air outlet 75T is lower for the class M1 printing material 12 than for the class M3 printing material 12 (temperature T4<temperature T6), for example. This makes it possible to reduce the likelihood that a low-heat resistance printing material 12 will be damaged by the heat. In addition, as illustrated in FIG. 3, in the foregoing embodiment, the control section 11 controls the respective operations of the first drying section 42 and the second drying section 75 so that a difference between the amount of heat per unit of surface area outputted to the printing material 12 from the first drying section 42 and the amount of heat per unit of surface area outputted to the printing material 12 from the second drying section 75 is lower when using the second medium (the class M1 printing material 12, for example), whose glass transition point is lower than the first medium, than when using the first medium (the class M3 printing material 12, for example) as the printing material 12. To rephrase, the control section 11 controls the respective operations of the first drying section 42 and the second drying section 75 so that the temperature difference Tc is greater for the class M1 printing material 12 than for the class M3 printing material 12, for example. Through this, heat can escape from the second surface 12*fb* side, even in the case where the first surface 12*fa* side of the printing material 12 has been heated by the first drying section 42. As a result, heat can escape from the second surface 12*fb* side while the first drying section 42 applies the amount of heat required to dry the ink from the first surface 12*fa* side of the printing material 12; this makes it possible to reduce the likelihood of the printing material 12 being damaged by the heat while drying the ink in a shorter amount of time, even in the case where a low-heat resistance printing material 12 is used.

Other Embodiment of Control Table

FIG. 7 is a diagram illustrating a control table Tba according to another embodiment. In the foregoing embodiments, the control section 11 may control the operations of the drying unit 40 by referring to the control table Tba instead of the control table Tb (FIG. 3). According to the control table Tba, the operation of the heat drying section 42 is controlled so that the temperature Tfa becomes a set temperature T1*a* regardless of the heat resistance of the printing material 12. In other words, the heat drying section 42 dries the ink applied to the printing material 12 at the same output (that is, with the same controlled operations) regardless of the heat resistance of the printing material 12. The temperature T1*a* is higher than the temperatures T4 to T6. It is preferable that the temperature T1*a* be set to a range of 80° C. to 120° C. in order to evaporate the moisture within the ink. By using the control table Tba, the heat drying section 42 can easily apply the amount of heat required to evaporate the moisture contained in the ink applied to the first surface 12*fa* regardless of the heat resistance of the printing material 12. The control performed by the control section 11 can also be simplified.

Variations

The invention is not intended to be limited to the foregoing working examples and embodiments, and can be realized in various forms without departing from the essential spirit thereof; for example, variations such as those described hereinafter are also possible.

First Variation

In the foregoing embodiments, although the heat drying section 42, the second drying section 75, and so on as drying the first surface 12*fa* of the printing material 12 by blowing heated air on the printing material 12, the invention is not limited thereto, and any configuration capable of heating and drying the printing material 12 may be employed. For example, the first surface 12*fa* of the printing material 12 may be heated and dried by radiant heat from a halogen heater or the like. Furthermore, although the heating section 47 is described as a halogen lamp, the invention is not limited thereto, and any configuration capable of heating the second surface 12*fb* of the printing material 12 may be employed. For example, the configuration may be such that warm air is blown onto the inner circumferential surface 41*w* of the support portion 41T. Furthermore, although the cooling section 49 is described as a cool air machine, any configuration capable of cooling the second surface 12*fb* of the printing material 12 may be employed. For example, a circulating channel for a coolant such as water that circulates between the exterior and the interior of the support portion 41T, may be formed, and the support portion 41T may be cooled by the coolant.

Second Variation

Although the printing apparatus 10 is described as having the control table Tb, an external device aside from the printing apparatus 10 may have the control table Tb. In this case, the external device is connected to the printing apparatus 10, and the control section 11 controls the operations of the drying unit 40*a* or 40*b* by referring to the control table Tb in the external device.

This application claims priority to Japanese Patent Application No. 2014-252637 filed on Dec. 15, 2014. The entire disclosure of Japanese Patent Application No. 2014-252637 is hereby incorporated herein by reference.

What is claimed is:

1. A drying apparatus comprising:

a heat drying section that heats a medium to which a liquid has been applied from a first surface side of the medium;

a temperature adjusting section that adjusts a temperature of the medium from a second surface side of the medium, the second surface being on the opposite side to the first surface; and a control section configured to control the heat drying section and the temperature adjusting section, the control section being further configured to change a difference between the temperature of the medium on the first side and the temperature of the medium on the second surface side by controlling the heat drying section and the temperature adjusting section individually in accordance with the type of the medium.

2. The drying apparatus according to claim 1, wherein the control section controls the heat drying section and the temperature adjusting section individually based on a set that includes a first target value indicating a target temperature value for the first surface side and a second target value indicating a target temperature value for the second surface side and that is different depending on the type of the medium.

3. A printing apparatus comprising:

an ejecting section for ejecting a liquid onto a medium; and the drying apparatus according to claim 2.

4. The drying apparatus according to claim 1, wherein the control section controls the temperature adjusting section so that an amount of heat outputted from the temperature adjusting section to the medium is lower when using a second medium having a lower glass transition point than a first medium than when using the first medium as the medium.

5. A printing apparatus comprising:

an ejecting section for ejecting a liquid onto a medium; and the drying apparatus according to claim 4.

6. The drying apparatus according to claim 1, wherein the control section controls the heat drying section and the temperature adjusting section so that a difference between an amount of heat outputted from the heat drying section to the medium and an amount of heat outputted from the temperature adjusting section to the medium is greater when using a second medium having a lower glass transition point than a first medium than when using the first medium as the medium.

7. A printing apparatus comprising:

an ejecting section for ejecting a liquid onto a medium; and the drying apparatus according to claim 6.

8. The drying apparatus according to claim 1, further comprising:

a control table that defines, on a medium type-by-medium type basis, amounts of heat applied to the medium by the heat drying section and the temperature adjusting section, wherein the control section controls operations of the heat drying section and the temperature adjusting section by referring to the control table.

9. A printing apparatus comprising:

an ejecting section for ejecting a liquid onto a medium; and the drying apparatus according to claim 8.

10. The drying apparatus according to claim 1, wherein the heat drying section dries the medium using the same output regardless of the type of the medium.

11. A printing apparatus comprising:

an ejecting section for ejecting a liquid onto a medium; and the drying apparatus according to claim 10.

12. The drying apparatus according to claim 1, wherein the temperature adjusting section includes a cooling device for cooling the second surface of the medium.

13. A printing apparatus comprising:

an ejecting section for ejecting a liquid onto a medium; and the drying apparatus according to claim 12.

14. The drying apparatus according to claim 1, wherein the control section controls the temperature adjusting section so that a temperature on the second surface side is lower when using a second medium having a lower glass transition point than a first medium than when using the first medium as the medium.

15. A printing apparatus comprising:

an ejecting section for ejecting a liquid onto a medium; and the drying apparatus according to claim 14.

16. The drying apparatus according to claim 1, wherein the control section controls the heat drying section and the temperature adjusting section so that a temperature on the first surface side is greater than or equal to a temperature on the second surface side and so that a difference between the temperature on the first surface side and the temperature on the second surface side is greater when using a second medium having a lower glass transition point than a first medium than when using the first medium as the medium.

17. A printing apparatus comprising:

an ejecting section for ejecting a liquid onto a medium; and the drying apparatus according to claim 16.

18. The drying apparatus according to claim 1, wherein the temperature adjusting section includes a cylindrical support portion having a circumferential surface configured such that the medium is wrapped thereupon and an adjustment mechanism section that adjusts a temperature of the circumferential surface; and the heat drying section and the temperature adjusting section dry the medium in a state where the medium is wrapped upon the circumferential surface.

19. A printing apparatus comprising:

an ejecting section for ejecting a liquid onto a medium; and the drying apparatus according to claim 1.

20. A drying method comprising:

heating and drying a medium to which a liquid has been applied from a first surface side of the medium; and adjusting a temperature of the medium from a second surface side of the medium, the second surface being on the opposite side to the first surface, a difference between the temperature of the medium on the first side and the temperature of the medium on the second surface side being changed by executing the heating and drying of the medium and the adjusting of the temperature of the medium individually in accordance with the type of the medium.

* * * * *